US005815768A

United States Patent [19]

Clifton

[11] Patent Number: 5,815,768

[45] Date of Patent: Sep. 29, 1998

[54] DETECTION OF TONER DEPLETION IN AN ELECTROPHOTOGRAPHIC PRINTING SYSTEM

[75] Inventor: George B. Clifton, Boise, Id.

[73] Assignee: Hewlett-Packard Company, Palo Alto, Calif.

[21] Appl. No.: 810,317

[22] Filed: Feb. 28, 1997

[51] Int. Cl.[6] ..... G03G 15/08

[52] U.S. Cl. ..... 399/27; 399/49; 399/55

[58] Field of Search ..... 399/27, 28, 29, 399/49, 30, 50, 51, 55

[56] References Cited

U.S. PATENT DOCUMENTS

| | | | |
|---|---|---|---|
| 4,903,051 | 2/1990 | Egawa et al. | 347/137 |
| 4,914,459 | 4/1990 | Mama et al. | 347/133 |
| 4,934,314 | 6/1990 | Ideyama | 399/30 |
| 5,160,966 | 11/1992 | Shiina et al. | 399/27 |
| 5,196,886 | 3/1993 | Nakane et al. | 399/27 |
| 5,198,861 | 3/1993 | Hasegawa et al. | 399/27 |
| 5,532,794 | 7/1996 | Tokuyama et al. | 399/49 |
| 5,581,221 | 12/1996 | Kawai et al. | 399/49 |
| 5,581,327 | 12/1996 | Izumizaki et al. | 399/30 |
| 5,594,533 | 1/1997 | Katoh | 399/50 X |
| 5,666,588 | 9/1997 | Uchiyama et al. | 399/44 |

FOREIGN PATENT DOCUMENTS

| | | |
|---|---|---|
| 0520144 | 3/1992 | European Pat. Off. . |
| 61-088284 | 5/1986 | Japan . |
| 09114226 | 5/1997 | Japan . |

OTHER PUBLICATIONS

European Search Report Application No. EP 98 10 0860; May 20, 1998.

*Primary Examiner*—Robert Beatty
*Assistant Examiner*—Sophia S. Chen
*Attorney, Agent, or Firm*—Gregg W. Wisdom

[57] ABSTRACT

A toner depletion detection system in an electrophotographic printer uses an optical density sensor to detect the depletion of toner. The optical density sensor is used by the electrophotographic printer to maintain the developed optical density at an optimum value by adjusting a DC offset voltage supplied to a developer to compensate for changes in the developed optical density. Additionally, the optical density sensor is used in a calibration which linearizes the relationship between the optical density of a developed halftone pattern and increments of the laser pulse width. In a first embodiment of the toner depletion detection system, the magnitude of the DC offset voltage supplied to the developer to compensate for changes in the developed optical density is monitored. When the magnitude of this DC offset voltage exceeds an empirically determined threshold value, the toner depletion condition is indicated. In a second embodiment of the toner depletion detection system, the relationship between the optical density of a developed halftone pattern and increments of the laser pulse width is periodically determined by the electrophotographic printer. When this relationship has shifted sufficiently, relative to a empirically determined threshold relationship, the toner depletion condition is indicated.

20 Claims, 5 Drawing Sheets

DETECTION OF TONER DEPLETION IN AN ELECTROPHOTOGRAPHIC PRINTING SYSTEM

FIELD OF THE INVENTION

This invention relates to the detection of the toner level in an electrophotographic imaging system. More particularly, this invention relates to the detection of toner depletion in an electrophotographic printer.

BACKGROUND OF THE INVENTION

When the toner supply in an electrophotographic (EP) cartridge is nearing complete consumption, some electrophotographic printers have the capability of displaying a toner low message on the display of the printer. A variety of different techniques are used to detect the depletion of toner. For example, one method relies upon the change that results in the average value of a capacitively coupled current when the supply of toner is low. Another method optically detects the presence or absence of toner. Typically, the sensing devices used to detect a low level of toner do not do so with high accuracy. Therefore, changing the EP cartridge at the first indication of depletion of the toner supply frequently results in the loss of a substantial portion of the useful life of the EP cartridge. It is often the case that after display of a message on the printer indicating that the toner has been depleted, toner sufficient for the printing of several hundred pages remains within the EP cartridge.

For monochrome electrophotographic printers, many users continue printing past the time at which the printer indicates that the toner is depleted and until the print begins fade. At the time at which the printer indicates that the toner has been depleted, additional useful life can be obtained in many EP cartridges by removing and shaking the EP cartridge. The shaking displaces toner that has settled in various recesses within the EP cartridge, making it available to flow to the developer. For those EP cartridges in which the printing life can be extended by shaking, a user may go through several cycles of print fade followed by EP cartridge shaking to consume the useable toner within the EP cartridge. The design of some electrophotographic printers (including color electrophotographic printers) is such that toner does not accumulate in recesses within the EP cartridge. For these printers, removal and shaking of the EP cartridge after the first indication that the toner is depleted does not substantially extend the printing life of the EP cartridge beyond what it would be without shaking. However, even in these types of EP cartridges, the toner remaining within the EP cartridge provides useable printing life beyond the detection of the toner depleted condition using the prior art toner detection devices.

Monochrome electrophotographic printing systems are designed to maintain a minimum optical density in printed areas of the page. Controlling the amount of toner deposited on the page in this manner maintains minimum printed line widths over a wide variety of printing conditions. Maintaining line widths above a minimum value is an important aspect of print quality. When the toner in the reservoir within the EP cartridge is depleted to the point at which toner is not available to replenish the supply of toner on the developer within the EP cartridge, the optical density of printed areas on the page, as well as the width of lines will begin to decrease so that the print quality is adversely affected.

In color electrophotographic printing systems, reproducing the colors in printed images with high fidelity requires tight control over the mass of each of the constituent colors deposited on the page. As each of the EP cartridges containing the colored toners becomes depleted of toner to the extent that toner is not available to replenish the toner supply on the respective developers, the print quality of the printed color images will be degraded. Both the printed line width and the quality of the color reproduction will be impacted by the toner depletion.

Determining from the printed page the actual point at which the useable toner has been consumed results in lost time and wasted print media because print jobs with inadequate print quality are produced. This can be particularly true in color printing. It is not unusual for users of color printers to print large jobs during the off hours because of the time required for printing. If during the printing of a large print job the EP cartridges became depleted of toner so that the print quality was degraded, a substantial loss of time and waste of print media would result. More accurately detecting the point at which toner depletion results in unacceptable print quality allows the user to install a new EP cartridge with the certainty that the useable life of the currently installed EP cartridge is not wasted.

SUMMARY OF THE INVENTION

As a solution to this problem, a method for detecting the depletion of toner permits accurate detection of the depletion of toner. The method is applicable in an electrophotographic imaging system, such as an electrophotographic printer, containing an optical density sensor for measuring the optical density of toner developed onto an area of a photoconductor, such as photoconductor drum or photoconductor belt, a power supply having an output to provide a voltage, and a developer to develop toner onto the photoconductor.

The method includes using the developer to develop the toner onto the area of the photoconductor in one of a plurality of pre-defined patterns. Next, the optical density of the toner developed onto the area of the photoconductor is measured. Then, the developing step and the measuring step are performed a plurality of times to generate a plurality of optical density measurements. Finally, the depletion of toner is detected using the plurality of optical density measurements.

In a first embodiment of the method for detecting the depletion of the toner, the plurality of pre-defined patterns are formed by successively setting the pulse width of a laser beam used to expose the photoconductor to one of a plurality of pre-defined pulse width values. By comparing the relationship between the plurality of optical density measurements and the corresponding plurality of pre-defined pulse width values of the laser beam to a pre-determined relationship between the optical density and pulse width values of the laser beam, the depletion of toner is detected.

In a second embodiment of the method for detecting the depletion of the toner, the plurality of pre-defined patterns are formed by successively setting the voltage provided by the power supply to the developer to one of a plurality of pre-defined voltage values. By using the plurality of optical density measurements and the plurality of pre-defined voltage values, a first value of the voltage necessary to develop the area on the photoconductor so that the optical density is substantially equal to a pre-determined second value of the optical density is determined. By comparing the first value of the voltage to a third value of the voltage, the depletion of toner is indicated.

DESCRIPTION OF THE DRAWINGS

A more thorough understanding of the invention may be had from the consideration of the following detailed description taken in conjunction with the accompanying drawings in which.

DETAILED DESCRIPTION OF THE PREFERRED EMBODIMENTS

The present invention is not limited to the specific exemplary embodiments illustrated herein. Although the embodiments of the toner depletion detection system will be discussed in the context of a monochrome electrophotographic printer, one of ordinary skill in the art will recognize by understanding this specification that the toner depletion detection system has applicability in both color and monochrome electrophotographic image forming systems. Furthermore, although the embodiments of the toner depletion detection system will be discussed in the context of a monochrome electrophotographic printer using a photoconductor drum, one of ordinary skill in the art will recognize by understanding this specification that another type of photoconductor, such as a photoconductor belt, could be used. Throughout this specification, the term "depletion of toner" refers to the condition in which the embodiments of the toner depletion detection system determine that the relevant parameter being monitored has crossed a predetermined threshold.

Figure 1:
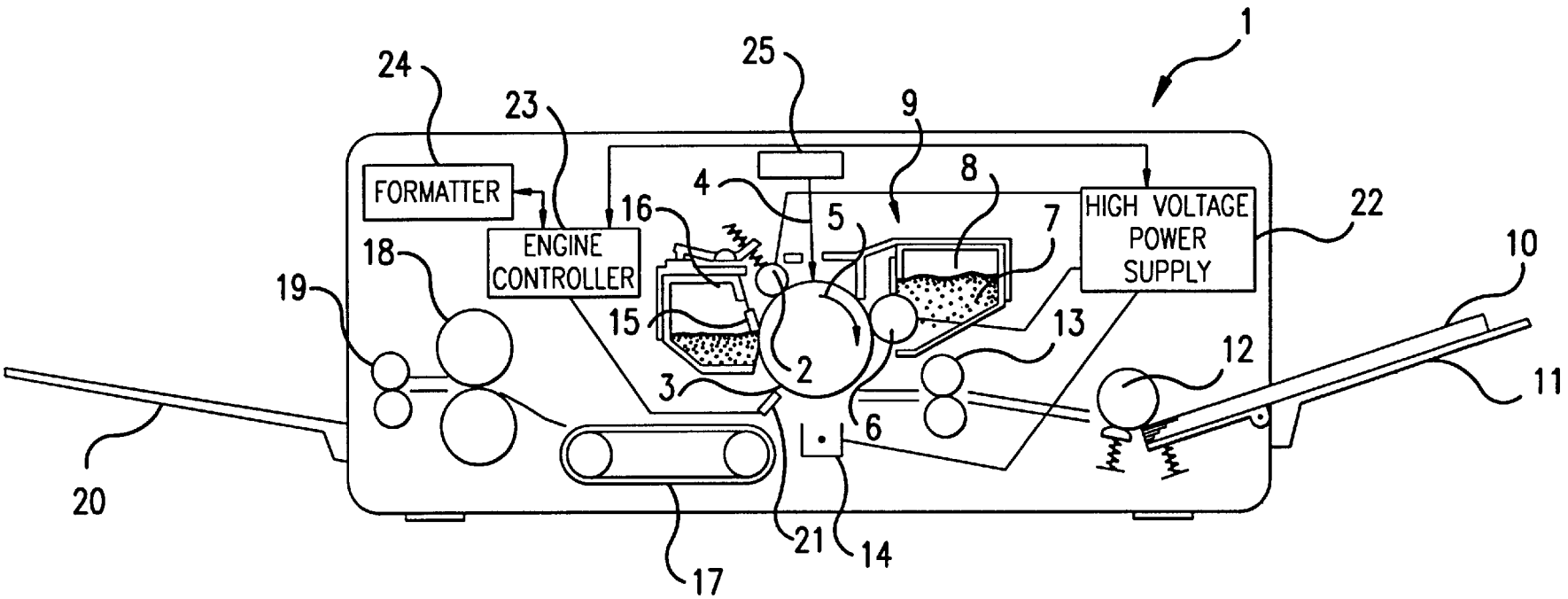
FIG. 1 is a simplified schematic of an electrophotographic printer including the elements of an embodiment of the toner depletion detection system.

Referring to FIG. 1, shown is a cross sectional view of an electrophotographic printer 1 containing an embodiment of the toner depletion detection system. Charge roller 2 is used to charge the surface of photoconductor drum 3 to a predetermined voltage. A laser diode in laser scanner 25 emits a laser beam 4 which is pulsed on and off as it is swept across the surface of photoconductor drum 3 by laser scanner 25 to selectively discharge the surface of the photoconductor drum 3. Photoconductor drum 3 rotates in the clockwise direction as shown by the arrow 5. Developer 6 is used to develop the latent electrostatic image residing on the surface of photoconductor drum 3 after the surface voltage of the photoconductor drum 3 has been selectively discharged. Toner 7 which is stored in the toner hopper 8 of electrophotographic print cartridge 9 moves from locations within the toner hopper 8 to the developer 6. The magnet located within the developer 6 magnetically attracts the toner to the surface of the developer 6. As the developer 6 rotates in the counterclockwise direction, the toner on the surface of the developer 6, located opposite the areas on the surface of photoconductor drum 3 which are discharged, is moved across the gap between the surface of the photoconductor drum 3 and the surface of the developer 6 to develop the latent electrostatic image.

Print media 10 is loaded from paper tray 11 by pickup roller 12 into the paper path of the electrophotographic printer 1. Print media 10 moves through the drive rollers 13 so that the arrival of the leading edge of print media 10 below photoconductor drum 3 is synchronized with the rotation of the region on the surface of photoconductor drum 3 having a latent electrostatic image corresponding to the leading edge of print media 10. As the photoconductor drum 3 continues to rotate in the clockwise direction, the surface of the photoconductor drum 3, having toner adhered to it in the discharged areas, contacts the print media 10 which has been charged by transfer corona 14 so that it attracts the toner particles away from the surface of the photoconductor drum 3 and onto the surface of the print media 10. The transfer of toner particles from the surface of photoconductor drum 3 to the surface of the print media 10 does not occur with one hundred percent efficiency and therefore some toner particles remain on the surface of photoconductor drum 3. As photoconductor drum 3 continues to rotate, toner particles which remain adhered to its surface are removed by cleaning blade 15 and deposited in toner waste hopper 16.

As the print media 10 moves in the paper path past photoconductor drum 3, conveyer belt 17 delivers the print media 10 to the fuser assembly 18. In the fuser assembly 18, heat is applied so that the toner particles are fused to the print media 10. Output rollers 19 push the print media 10 into the output tray 20 after it exits the fuser assembly 18. Further details on electrophotographic process can be found in the text "The Physics and Technology of Xerographic Processes", by Edgar M. Williams, 1984, a Wiley-Interscience Publication of John Wiley & Sons, the disclosure of which is incorporated by reference herein.

A high voltage power supply 22 supplies the bias voltages and bias currents to the charge roller 2, transfer corona 14, and developer 6 necessary for operation of the electrophotographic processes. The charge roller 2 is driven with a sinusoidal voltage waveform having a negative D.C. offset. The amplitude and frequency of the sinusoid are selected to so that the surface of photoconductor drum 3 on which charge will be deposited is uniformly charged at approximately the value of the D.C. offset. The transfer corona 14 is driven with positive DC voltage during the transfer operation. The developer 6 is driven with a sinusoid voltage waveform having a variable negative D.C. offset.

To faithfully reproduce images and maintain the desired optical density on the print media, electrophotographic printer 1 employs an optical density sensor 21. Periodically, electrophotographic printer 1 undergoes a calibration cycle in which a correction is made for the various factors which affect the optical density of the toner developed onto the surface of photoconductor drum 3. Factors which affect the amount of toner developed onto the surface of photoconductor drum 3 (thereby affecting the optical density) include such things as changing environmental conditions, wear-out mechanisms affecting photoconductor drum 3, and changes in charging characteristics of the toner. For example, over the operating humidity range of electrophotographic printer 1, both the charge to mass ratio of toner 7 and the effectiveness of charge roller 2 in charging photoconductor drum 3 change. Over the operating temperature range, the discharge voltage of the photoconductor drum 3 varies. As the photoconductor drum 3 experiences wear from contact with print media 10 and from optical fatigue, the discharge voltage of the photoconductor drum 3 changes. Typically, the calibration cycle is performed after the printing of a fixed number of pages. However, it may be performed more frequently or less frequently as circumstances warrant. In addition, a calibration is performed at start up to set the optical density of the developed toner at the initial desired value.

The calibration process involves the development of areas of varying optical density on photoconductor drum 3 for measurement by optical density sensor 21. Five consecutive areas of different optical density are developed onto the surface of photoconductor drum 3. High voltage power supply 22 is commanded by engine controller 23 to supply five consecutive pre-determined values of DC offset voltage to developer 6. As well as controlling the operation of high voltage power supply 22, engine controller 23 controls the operation of the previously mentioned components of electrophotographic printer 1 to generate a printed image. It should be recognized that the number of pre-determined values of the DC offset voltage used may vary depending upon the specifics of the electrophotographic system on which the calibration is performed.

Figure 2:
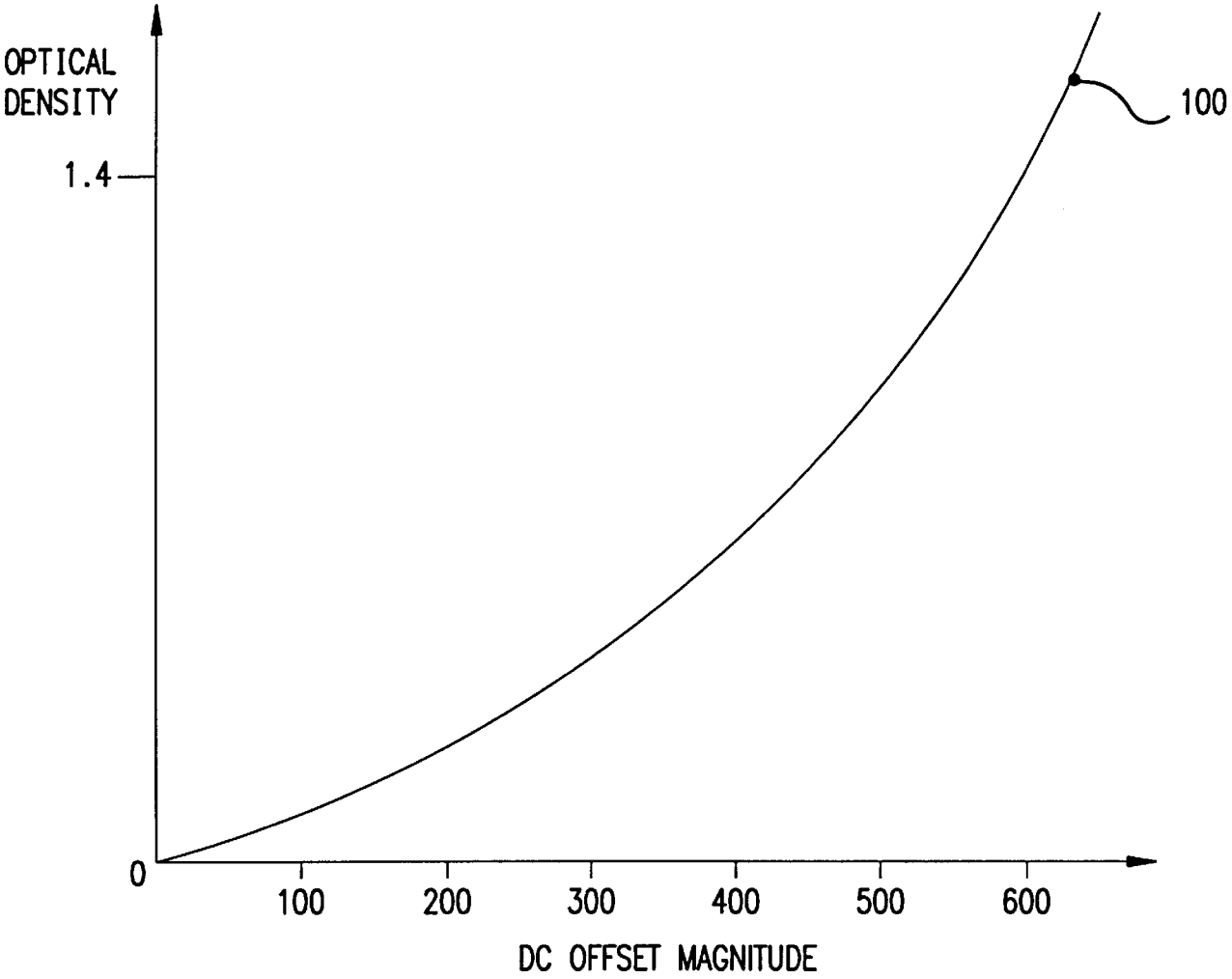
FIG. 2 shows a typical relationship between the developed optical density and the magnitude of the DC offset voltage applied to the developer.

At each of the DC offset voltage values, toner is developed onto photoconductor drum 3. The optical density of each of these areas developed onto photoconductor drum 3 is measured by optical density sensor 21. Engine controller 23 records the value of the measured optical density and the corresponding value of the DC offset voltage. By interpolating from the collected data, engine controller 23 determines the proper DC offset voltage required to generate the optimum optical density to ensure high image quality. Shown in FIG. 2 is a graph of a typical relationship expected between the measured optical density on photoconductor drum 3 and the applied developer DC offset voltage. The optimum optical density point 100 is selected for the developer 6 so that the DC offset voltage applied by high voltage power supply 22 is sufficient to meet the minimum specified optical density for a solid printed area over a wide range of printing conditions. The DC offset voltage is adjusted so that the optical density of developed areas is substantially equal to the optical density at the optimum optical density point 100. The term "substantially equal" refers to equality within the measurement tolerances of optical density sensor 21 and the variation in developed optical density which results from variability in the electrophotographic printing of electrophotographic printer 1.

It should be recognized that there are parameters, other than the DC offset voltage applied to developer 6, which can be adjusted to control the optical density of toner 7 developed onto photoconductor 3. For example, by varying the amplitude or frequency of the AC bias voltage applied to developer 6 by high voltage power supply 22, the mass of toner 7 developed onto photoconductor drum 3 can be controlled. By monitoring the amplitude of AC bias voltage or the frequency of the AC bias voltage required to maintain the optical density substantially equal to the value at the optimum optical density point 100, the toner depletion condition could be detected. Additionally, by controlling the optical power of laser beam 4, the voltage on the exposed areas of the surface of photoconductor drum 3 can be adjusted to control the mass of toner 7 developed onto photoconductor drum 3 by developer 6. By monitoring the optical power of the laser beam 4 required to maintain the optical density substantially equal to the value at optimum optical density point 100, the toner depletion condition could be detected. Furthermore, by adjusting the AC and/or DC voltages applied to a charging member, such as charge roller 2 or a charging blade, the voltage on the surface of photoconductor drum 3 could be varied to control the mass of toner 7 developed onto photoconductor drum 3. By monitoring the amplitude of the AC bias voltage or the magnitude of the DC voltage required to maintain the optical density substantially equal to the value at the optimum optical density point 100, the toner depletion condition could be detected.

Typically, an electrophotographic printer defines a pixel element as the smallest possible printable element. A pixel corresponds to the smallest possible area which can be discharged on the surface of photoconductor drum 3 by laser beam 4. Electrophotographic printer 1 includes the capability to adjust the pulse width of the laser beam 4 so that sub-pixel areas can be discharged on the surface of photoconductor drum 3. This capability allows electrophotographic printer 1 to print images with exceptional levels of image quality.

Figure 3:
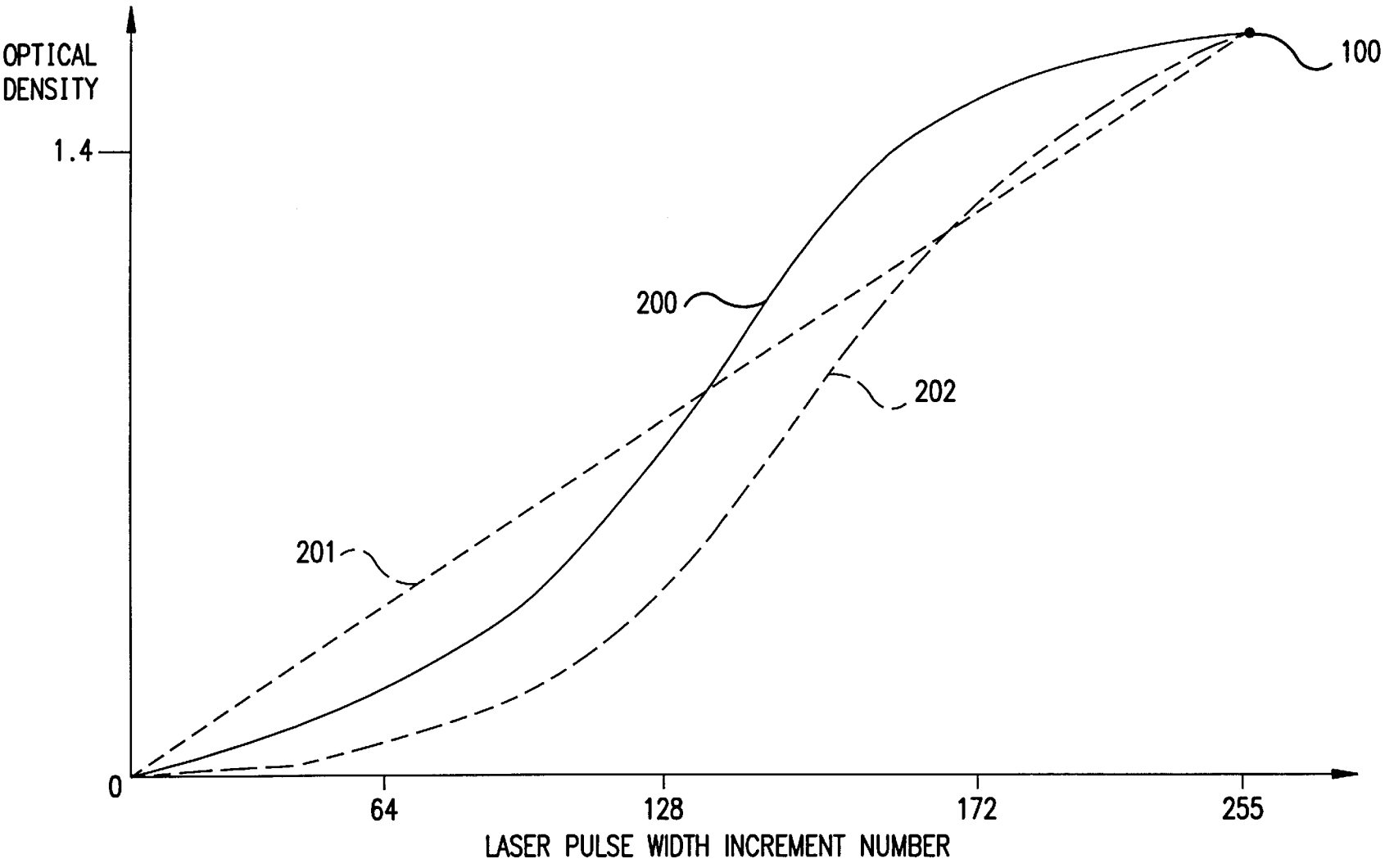
FIG. 3 shows a typical relationship between the developed optical density and the laser pulse width increment number for a nominal value of DC offset voltage applied to the developer.

Electrophotographic printer 1 allows control of the laser beam pulse width within a pixel in 256 discrete, equal size increments of pulse width. To optimally control the sensitivity of the measured optical density of a developed area on photoconductor drum 3 with respect to the laser pulse width, a linearization process is used. Shown in FIG. 3 is a graph of a representative relationship between the measured optical density on the surface of photoconductor drum 3 and the laser pulse width increment number for a given halftone pattern. As can be seen from this relationship, for certain ranges of the laser pulse width the optical density changes much more rapidly than in other ranges of laser pulse width. Linearization of this relationship would provide tighter control of the optical density over the entire range of possible sub-pixel laser pulse widths.

To perform this linearization process, engine controller 23 and formatter 24 control the electrophotographic process to generate developed areas on the surface of photoconductor drum 3 over the possible range of sub-pixel laser pulse widths with the DC offset voltage from the high voltage power supply 22 set to the value corresponding to the optimum optical density point 100. Optical density sensor 21 measures the optical density of the developed areas for each of the increments in the sub-pixel laser pulse widths. From the transfer function of optical density vs laser pulse width increment number which results, the engine controller 23 and formatter 24 compute the changes necessary for each of the increments of pulse width so that the non-linear optical density vs laser pulse width increment number characteristic 200 is transformed into a linear optical density vs laser pulse width increment number characteristic 201. Because the relationship will vary depending upon the particular type of halftoning method selected to generate the developed areas, this process must be repeated for each of the halftone methods employed.

Figure 4:
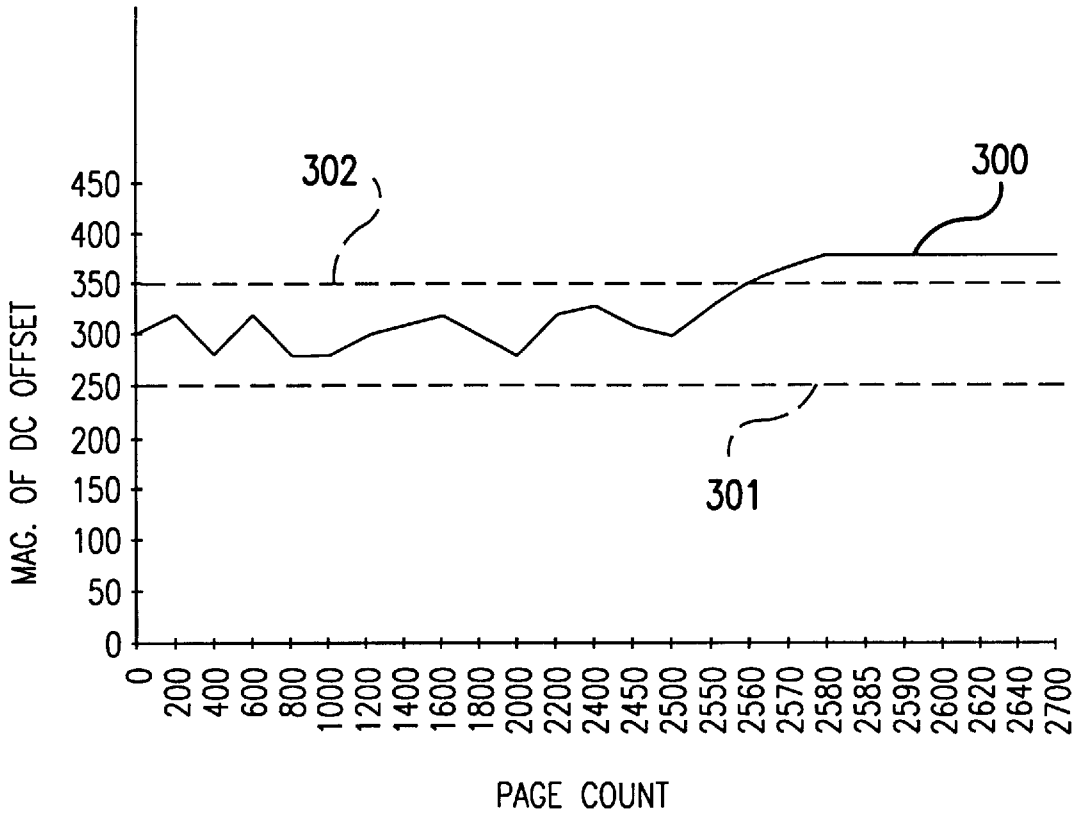
FIG. 4 shows a typical relationship between the magnitude of the DC offset voltage applied to the developer and the number of pages printed for the electrophotographic printer of FIG. 1.

Shown in FIG. 4 is a curve 300 showing the typical range of change in the DC offset voltage applied to developer 6 which might be expected over the printing life. The units of the horizontal axis are the number of pages printed. The vertical axis represents the magnitude of the DC offset voltage applied to developer 6. Over the printing life of the developer 6, the magnitude of the DC offset voltage necessary to set the optical density at the optimum optical density point 100 after each calibration varies as a result of previously mentioned factors. However, the variation in the DC offset voltage due to these previously mentioned factors (with the exception of the depletion of toner resulting from printing) is bounded. The boundaries of the variation in the DC offset voltage required to maintain the optical density at the optimum optical density point 100 during the printing life may be empirically determined. Shown in FIG. 4 is what might be a typical lower bound 301 and upper bound 302 of the expected variation in the DC offset voltage to maintain the optical density at the optimum optical density point 100. As the toner in the toner hopper 8 is depleted, the magnitude of the DC offset voltage required to compensate for the resulting change in the optical density of the areas developed during the calibration process increases. At some page count, the DC offset voltage required to compensate for the reduced optical density of the areas developed during calibration reaches upper bound 302. At this time, engine controller 23 can signal formatter 24, which in turn signals the user, that the useable toner has been consumed. In this manner, the value of the DC offset voltage required to maintain the optical density at the optimum optical density point 100 is used to determine when the toner is depleted. Beyond this level of toner depletion, the quality of the printed images generated by electrophotographic printer 1 will not necessarily comply with print quality specifications.

The magnitude of the DC offset voltage applied to developer 6 cannot be increased indefinitely. At some value, electrical breakdown across the developer gap will occur. The value of DC offset voltage at which breakdown occurs varies depending upon, for example, variation in the width of the developer gap and humidity. To maximize the usage of toner, it is preferable to set the upper bound 302 of the allowable variation in the magnitude of the DC offset voltage so that it is close to, but less than, the minimum expected value of the developer gap breakdown voltage. The difference which should exist between the minimum expected value of the developer gap breakdown voltage and the upper bound 302 depends upon the certainty with which the variability in the minimum breakdown voltage is known and how tightly the DC offset voltage can be controlled.

An alternative approach to detecting the level of toner depletion at which printed images may not meet image quality specifications makes use of the shift in the non-linear optical density vs laser pulse width increment number characteristic 200 as toner is consumed. As the DC offset voltage is adjusted to compensate for changes in reduced optical density, the optical density vs laser pulse width increment number characteristic 200 shifts to the right as shown in FIG. 3 by the shifted optical density vs laser pulse width increment number characteristic 202. By empirically characterizing the amount of shift occurring relative to the increase required in the DC offset voltage to compensate for the reduction in optical density, a limit could be established for the maximum allowed shift in optical density vs laser pulse width increment number characteristic 200. This limit would be reached when the value of the DC offset voltage at the upper bound 302 is reached. As is the case when the DC offset voltage is used to determine complete consumption of the useable toner, the specified image quality may not be achieved beyond this point.

Several other devices and methods to estimate toner usage are in existence. Currently, some electrophotographic printer designs use an antennae (not present in FIG. 1 ) located in the toner reservoir to capacitively detect the presence of toner between the antennae and developer. With toner serving as a dielectric in the capacitance coupling the antennae and developer, the capacitance of this arrangement is increased over the case in which air serves as the dielectric. The capacitive current coupled into the antennae from the AC voltage supplied to the developer is monitored by the engine controller. When air replaces toner as the dielectric, the drop in capacitive current is detected by the engine controller and the toner low condition is indicated to the user. However, because useable toner generally remains within the toner reservoir after detection of the toner low condition, this device does not accurately indicate when the useable toner has been consumed.

The exemplary electrophotographic printing system 1 could use an optical sensing method to detect the toner low condition in toner hopper 8. An optical sensing method would employ an optical source which is aligned to illuminate an optical detector when the toner becomes depleted. The location of the optical source and optical detector within toner hopper 8 determines how accurately this device detects consumption of the useable toner. As with the device which uses an antennae to detect the toner low condition, useable toner generally remains after the toner low condition is detected by the optical detector.

Figure 5:
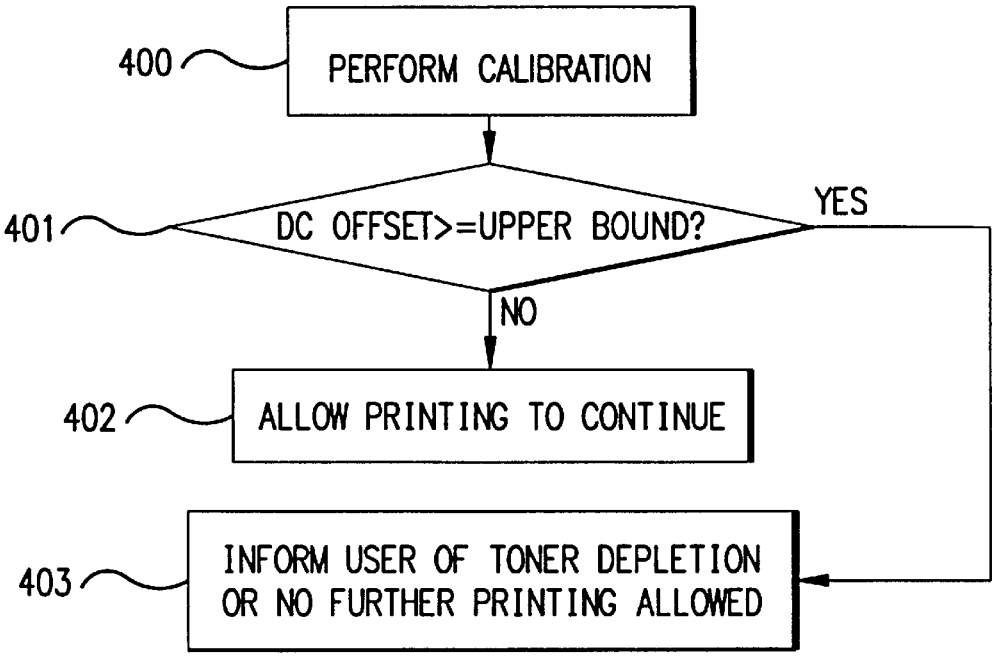
FIG. 5 shows the steps performed for detecting the depletion of toner using the first embodiment of the toner depletion detection system.

Either of these toner low detection schemes could be used in conjunction with the toner depletion detection system to optimally determine when the useable toner has been consumed. When the toner low condition is detected by either an optical or antennae method, the engine controller 23 could increase the frequency with which the calibration is made to determine the DC offset voltage required to set the optical density at the optimum optical density 100 value. When the upper bound 302 on the DC offset voltage is reached, the engine controller 23 could either prevent the user from continued printing or inform the user that the print quality would not be guaranteed with continued printing. Shown in FIG. 5 is a flow chart of a first method for detecting the condition of toner depletion in toner hopper 8 using the disclosed embodiment of the toner depletion detection system. First, electrophotographic printer 1 performs a calibration 400 to determine the value of the DC offset voltage required to set the optical density at the optimum optical density point 100. Next, engine controller 23 compares 401 the value of the DC offset voltage determined in calibration 400 to the upper bound 302 of the DC offset voltage magnitude. If the DC offset voltage magnitude is less than the upper bound 302 of the DC offset voltage magnitude, then engine controller 23 allows 402 printing to continue without taking any action. If the DC offset voltage magnitude is equal to or greater than the upper bound 302 of the DC offset voltage magnitude, then engine controller 23 informs 403 the user that the toner is depleted or that no further printing is allowed until the electrophotographic print cartridge 9 is replaced.

Figure 6:
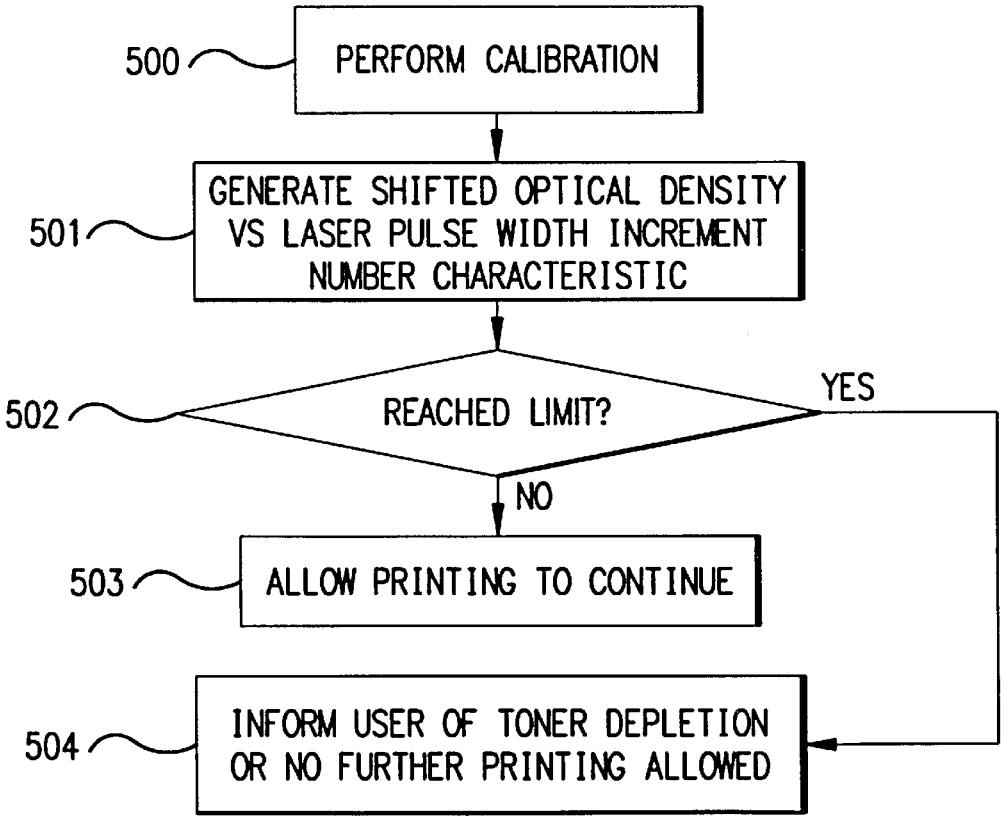
FIG. 6 shows the steps performed for detecting the depletion of toner using the second embodiment of the toner depletion detection system.

Shown in FIG. 6 is a flow chart of a second method for detecting the condition of toner depletion toner hopper 8 using the disclosed embodiment of the toner depletion detection system. First, electrophotographic printing system 1 performs a calibration 500 to determine the value of the DC offset voltage required to set the optical density at the optimum optical density point 100. Next, formatter 24 and engine controller 23 vary the laser pulse width for a given halftone pattern to generate 501 the shifted optical density vs laser pulse width increment number characteristic 202. Then, formatter 24 compares 502 the shifted optical density vs laser pulse width increment number characteristic 202 to the empirically derived limit. If the shifted optical density vs laser pulse width increment number characteristic 202 has not reached the limit, then engine controller 23 allows 503 printing to continue without taking any action. If the shifted optical density vs laser pulse width increment number characteristic 202 has reached or exceeded the limit, then engine controller 23 informs 504 the user that the toner is depleted or that no further printing is allowed until the electrophotographic print cartridge 9 is replaced.

Although several embodiments of the invention have been illustrated, and their forms described, it is readily apparent to those skilled in the art that various modifications may be made therein without departing from the spirit of the invention or from the scope of the appended claims.

What is claimed is:

1. In an electrophotographic imaging system including an optical density sensor for measuring the optical density of toner developed onto an area of a photoconductor, a power supply having a first output to provide a first voltage, and a developer for developing said toner coupled to said first output, a method for detecting the depletion of said toner comprising the steps of:

developing said toner onto said area of said photoconductor in one of a plurality of pre-defined patterns using said developer;

measuring said optical density of said toner developed onto said area of said photoconductor using said optical density sensor to generate an optical density measurement;

performing a plurality of said developing step and said measuring step to generate a plurality of said optical density measurement; and detecting a condition in which useable amounts of said toner have been completely consumed using said plurality of said optical density measurement.

2. The method as recited in claim 1, wherein:

said electrophotographic imaging system includes a laser scanner for generating a laser beam;

said step of developing includes a step of setting an optical power of said laser beam for exposing said photoconductor to one of a plurality of pre-defined optical power values corresponding to said one of said plurality of pre-defined patterns; and said step of detecting includes comparing a first relationship of said optical density and said optical power of said laser beam formed from said plurality of said optical density measurement and said plurality of said pre-defined optical power values to a second pre-determined relationship of said optical density and said optical power of said laser beam to indicate depletion of said toner.

3. The method as recited in claim 1, wherein:

said electrophotographic imaging system includes a charging member for charging said photoconductor, said power supply includes a second output for supplying a second voltage coupled to said charging member;

said step of developing includes a step of setting said second voltage to one of a first plurality of pre-defined values of said second voltage; and said step of detecting includes determining, using said plurality of said optical density measurement and said first plurality of pre-defined values of said second voltage, a second value of said second voltage necessary to develop said area of said photoconductor with said optical density substantially equal to a pre-determined first value of said optical density; and said step of detecting includes comparing said second value of said second voltage to a pre-determined third value of said second voltage to indicate depletion of said toner.

4. The method as recited in claim 1, wherein:

said electrophotographic imaging system includes a laser scanner for generating a laser beam; and said step of developing includes a step of setting a pulse width of said laser beam for exposing said photoconductor to one of a plurality of pre-defined pulse width values corresponding to said one of said plurality of pre-defined patterns.

5. The method as recited in claim 4, wherein:

said step of detecting includes comparing a first relationship of said optical density and said pulse width of said laser beam formed from said plurality of said optical density measurement and said plurality of said pre-defined pulse width values to a second pre-determined relationship of said optical density and said pulse width of said laser beam to indicate depletion of said toner.

6. The method as recited in claim 1, wherein:

said step of developing includes a step of setting said first voltage to one of a first plurality of pre-defined values of said first voltage.

7. The method as recited in claim 6, wherein:

said step of detecting includes determining, using said plurality of said optical density measurement and said first plurality of pre-defined values of said first voltage, a second value of said first voltage necessary to develop said area of said photoconductor with said optical density substantially equal to a pre-determined first value of said optical density; and said step of detecting includes comparing said second value of said first voltage to a pre-determined third value of said first voltage to indicate depletion of said toner.

8. The method as recited in claim 7, wherein:

said pre-defined pattern includes a solid pattern.

9. The method as recited in claim 8, wherein:

said photoconductor includes a photoconductor drum.

10. An electrophotographic imaging system using toner, comprising:

a photoconductor having a surface;

a power supply having an output to supply an externally controllable voltage;

a developer connected to said output for developing said toner onto said surface of said photoconductor;

an optical density sensor to generate an optical density measurement of said toner developed onto said surface of said photoconductor; and a controller configured to receive said optical density measurement from said optical density sensor, said controller operatively associated with said power supply for controlling said voltage to maintain said optical density measurement substantially at a first predetermined value, said controller for determining when a magnitude of said voltage becomes greater than or equal to a second pre-determined value, said second pre-determined value for indicating complete consumption of useable amounts of said toner in said developer.

11. The electrophotographic imaging system as recited in claim 10, wherein:

said electrophotographic imaging system includes a color electrophotographic printer.

12. The electrophotographic imaging system as recited in claim 10, wherein:

said electrophotographic imaging system includes a monochrome electrophotographic printer.

13. The electrophotographic imaging system as recited in claim 12, wherein:

said photoconductor includes a photoconductor drum; and said optical density sensor locates proximally with respect to said surface of said photoconductor drum for performing said optical density measurement on said toner developed onto said surface of said photoconductor drum.

14. The electrophotographic imaging system as recited in claim 13, wherein:

said controller includes the capability to control said optical density sensor and said power supply to perform a plurality of said optical density measurement on a corresponding plurality of locations on said surface of said photoconductor drum having said toner developed at a corresponding plurality of values of said voltage.

15. An electrophotographic imaging system using toner, comprising:

a laser scanner to generate a laser beam having a pulse width;

a photoconductor having a surface for exposure by said laser beam;

a developer to develop said toner onto said photoconductor;

an optical density sensor for generating an optical density measurement; and a controller coupled to said laser scanner and configured to receive said optical density measurement from said optical density sensor, said controller includes the capability to control said pulse width of said laser beam to expose a plurality of areas on said surface of said photoconductor with a pre-defined pattern using a corresponding plurality of said pulse width of said laser beam, said controller includes the capability to compare a first relationship of said optical density to said pulse width, formed from a plurality of said optical density measurements of said plurality of areas having said toner and said plurality of said pulse width, with a pre-determined second relationship of said optical density to said pulse width to indicate toner depletion.

16. The electrophotographic imaging system as recited in claim 15, wherein:

said electrophotographic imaging system includes a color electrophotographic printer.

17. The electrophotographic imaging system as recited in claim 16, wherein:

said electrophotographic imaging system includes a monochrome electrophotographic printer.

18. The electrophotographic imaging system as recited in claim 17, wherein:

said photoconductor includes a photoconductor drum.

19. The electrophotographic imaging system as recited in claim 18, wherein:

said pre-defined pattern includes a halftone pattern.

20. The electrophotographic imaging system as recited in claim 19, wherein:

said plurality of said pulse widths includes 256 distinct values of said pulse width.

* * * * *